US007871151B2

(12) United States Patent
Yamamoto et al.

(10) Patent No.: US 7,871,151 B2
(45) Date of Patent: Jan. 18, 2011

(54) LIQUID DISCHARGE HEAD

(75) Inventors: Akira Yamamoto, Yokohama (JP); Shuzo Iwanaga, Kawasaki (JP); Toshiaki Hirosawa, Hiratsuka (JP)

(73) Assignee: Canon Kabushiki Kaisha, Tokyo (JP)

( * ) Notice: Subject to any disclaimer, the term of this patent is extended or adjusted under 35 U.S.C. 154(b) by 683 days.

(21) Appl. No.: 11/942,123

(22) Filed: Nov. 19, 2007

(65) Prior Publication Data

US 2008/0151004 A1 Jun. 26, 2008

(30) Foreign Application Priority Data

Dec. 21, 2006 (JP) ..... 2006-344268

(51) Int. Cl.
*B41J 2/14* (2006.01)
*B41J 2/16* (2006.01)

(52) U.S. Cl. ..... 347/50; 347/17; 347/58; 347/72

(58) Field of Classification Search ..... 347/17, 347/18, 50, 56–59, 70–72
See application file for complete search history.

(56) References Cited

U.S. PATENT DOCUMENTS 6,099,109 A * 8/2000 Komuro ..... 347/50

FOREIGN PATENT DOCUMENTS

JP 2006-91012 4/2006

* cited by examiner

*Primary Examiner*—Juanita D Stephens

(74) *Attorney, Agent, or Firm*—Canon USA Inc IP Div

(57) ABSTRACT

A liquid discharge head includes a discharge element including a discharge port, a liquid supply port, an electric connection terminal, and a heat transfer terminal. The discharge head also includes a supporting member including an electric connection terminal portion formed on a first surface thereof and electrically connected to the electric connection terminal, a heat transfer terminal junction portion formed on the first surface and connected to the heat transfer terminal, a plurality of through-holes extending between the first surface and a second surface of the supporting member, a partition wall portion separating the through-holes from each other, and a heat transfer path connected to the heat transfer terminal junction portion. An interval between the through-holes increases according to a direction from the first surface to the second surface. A volume of the heat transfer path increases according to the increase of the interval.

5 Claims, 14 Drawing Sheets

LIQUID DISCHARGE HEAD

BACKGROUND OF THE INVENTION

1. Field of the Invention

The present invention relates to a liquid discharge head configured to discharge a liquid, such as ink, from a discharge port.

2. Description of the Related Art

In recent years, a liquid discharge head has widely spread as an ink jet recording head for discharging ink as a liquid. Further, the liquid discharge head has been in commercial use in the medical equipment field and others for discharging chemicals as a liquid. Attempts for commercializing and popularizing the liquid discharge head have led to a problem of how to make the liquid discharge head at a low cost. In that case, it is effective to miniaturize a discharge element substrate on which discharge elements are disposed. The discharge element generates energy for discharging a liquid. For example, if the discharge element substrate is miniaturized, the number of discharge element substrates that can be formed from a wafer is increased. Accordingly, such miniaturization enables the cost reduction of a liquid discharge head.

However, the miniaturization of a discharge element substrate results in a problem of how to radiate heat from the substrate and to secure a space for disposing an electric connection terminal.

Japanese Patent Application Laid-Open No. 2006-91012 discusses a liquid discharge head capable of solving such a problem. This liquid discharge head includes an electric connection terminal for connecting electricity to the outside and a structure for radiating heat on the back side of a discharge element substrate. The back side of the discharge element substrate does not include an electric circuit and a flow path structure for discharging a liquid. Furthermore, Japanese Patent Application Laid-Open No. 2006-91012 discusses a liquid discharge head 600 as illustrated in FIG. 15. The liquid discharge head 600 includes four discharge element substrates 601 mounted on a supporting member. Each discharge element substrate 601 is provided with one liquid supply port 602. The supporting member 603 is made of a ceramic sheet laminated body in which a through-hole 604 for supplying a liquid and an electric wiring 605 are incorporated.

However, progress in miniaturization of a liquid discharge head results in a configuration in which one discharge element head substrate is provided with a plurality of liquid supply ports. This configuration also narrows the interval between through-holes of the ceramic sheet laminated body, which communicate with the liquid supply ports. An ink jet recording head, which is an example of a liquid discharge head, also tends to lengthen a discharge element substrate (recording element substrate) for attaining high-speed recording and to form a number of ink discharge port arrays on the recording element substrate for attaining a high-quality image. For this reason, a ceramic sheet laminated body will include a plurality of long and thin through-holes (ink flow paths) at a narrow pitch.

As a result of driving for liquid discharge, heat generated by an electric circuit and an element which generates discharge energy is transferred from a discharge element substrate to a ceramic sheet laminated body. However, a narrow partition wall between through-holes of the ceramic sheet laminated body, which provides a heat radiation path, results in a problem that it is difficult to radiate heat sufficiently.

Concerning this problem, in a more miniaturized ink jet recording head, a long and thin partition wall is formed along ink discharge port arrays (that is, along an ink supply port).

Accordingly, after heat is transferred to the partition wall, a through-hole (ink flow path) blocks the heat transfer. As a result, heat is almost transferred along the longitudinal direction of the partition wall. In such circumstances, the discharge of ink will cause a rise in temperature at the center part in a longitudinal direction of the partition wall, because the radiation of heat at the center part in a longitudinal direction of the recording element substrate is not sufficient.

Such a high temperature rise may generate failures, such as occurrence of a faulty operation of a circuit formed on the recording element substrate, degradation of image quality due to variations in temperature in the longitudinal direction, and difficulty in discharging ink due to air bubbles remaining in a ink flow path.

This provides an important problem in a liquid discharge head which discharges ink using thermal energy generated by a heating element. This is because unless a region located around the heating element sufficiently performs heat radiation, the temperature of the region rises instantaneously.

SUMMARY OF THE INVENTION

The present invention is directed to a liquid discharge head capable of efficiently radiating heat transferred from a discharge element substrate to a partition wall provided between through-holes. In the liquid discharge head, a plurality of liquid supply through-holes is disposed at a narrow pitch in a supporting member.

According to an aspect of the present invention, a liquid discharge head includes a discharge element including, on a front surface thereof, a discharge port for discharging a liquid and, on a second surface thereof, a liquid supply port communicating with the discharge port, an electric connection terminal, and a heat transfer terminal. The liquid discharge head also includes a supporting member including a first surface, a second surface, an electric connection terminal portion formed on the first surface of the supporting member and electrically connected to the electric connection terminal, a heat transfer terminal junction portion formed on the first surface of the supporting member and connected to the heat transfer terminal to transfer heat, a plurality of through-holes extending between the first surface and the second surface of the supporting member, a partition wall portion separating the through-holes from each other, and a heat transfer path connected to the heat transfer terminal junction portion, the supporting member supporting the discharge element on the first surface of the supporting member. The through-holes communicate with the liquid supply port and are formed such that an interval between the through-holes increases according to a direction from the first surface to the second surface of the supporting member. Further, a volume of the heat transfer path increases according to the increase of the interval.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DETAILED DESCRIPTION OF THE EMBODIMENTS

Various exemplary embodiments, features, and aspects of the invention will be described in detail below with reference to the drawings.

Figure 1:
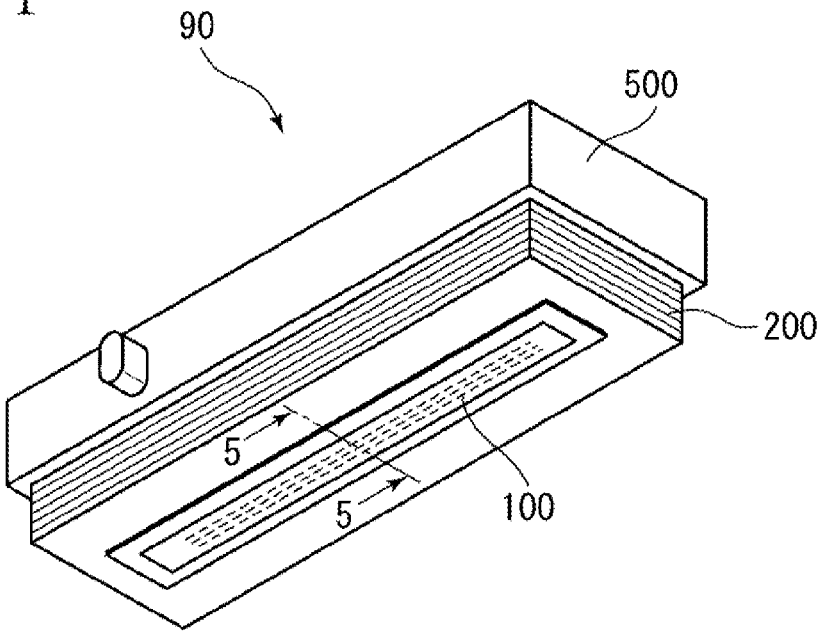
FIG. 1 is a perspective view illustrating an ink jet recording head as a liquid discharge head according to an exemplary embodiment of the present invention.

FIG. 1 is a perspective view illustrating an ink jet recording head as a liquid discharge head according to an exemplary embodiment of the present invention.

A supporting member 200 includes a wiring for supplying electric power to a recording element substrate 100, which serves as a discharge element substrate. The supporting member 200 supports the recording element substrate 100. The supporting member 200 radiates heat from the recording element substrate 100. An ink supply member 500 is a component for supplying ink as a liquid from an ink tank (not illustrated) to the recording element substrate 100. The ink supply member 500 and the supporting member 200 are joined by an adhesive or the like. The recording element substrate 100, the supporting member 200, and the ink supply member 500 constitute an ink jet recording head 90. The ink supply member 500 is configured to allow an ink tank (not illustrated) to be detachably mounted thereon.

Figure 2:
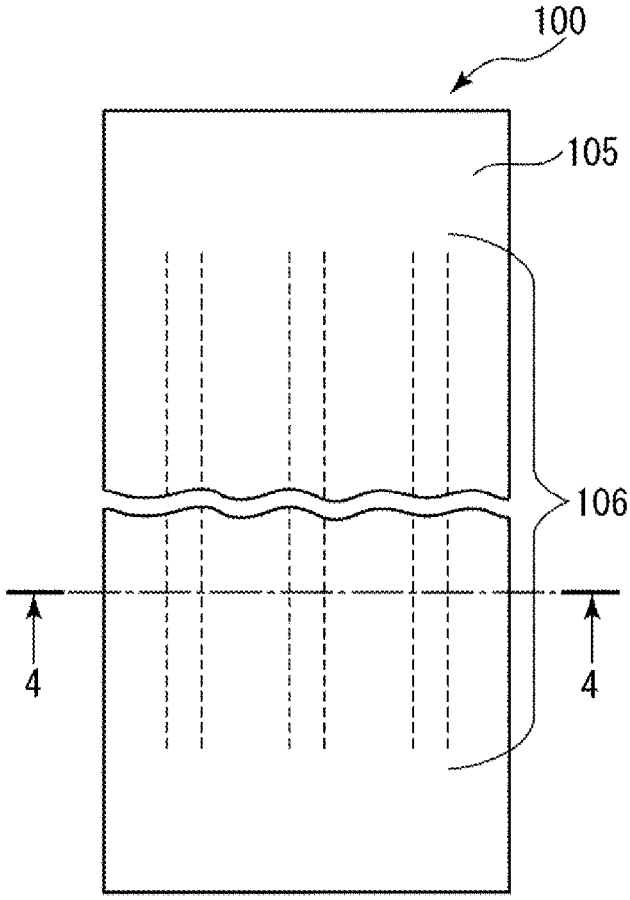
FIG. 2 is a diagram illustrating a recording element substrate of an ink jet recording head as viewed from the first surface according to an exemplary embodiment of the present invention.
Figure 3:
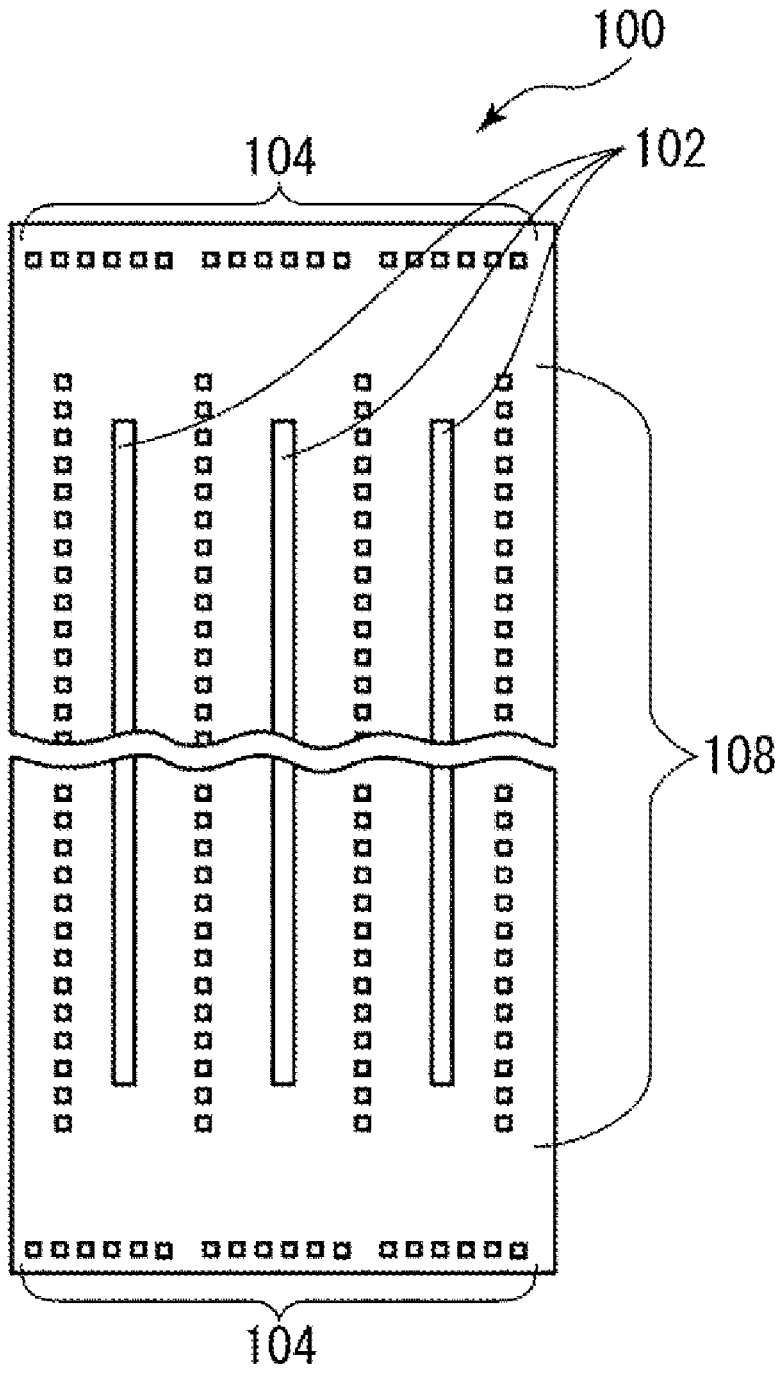
FIG. 3 is diagram illustrating a recording element substrate of an ink jet recording head as viewed from the second surface according to an exemplary embodiment of the present invention.

FIG. 2 is a diagram illustrating the recording element substrate 100 as viewed from the first surface of the recording element substrate 100. FIG. 3 is a diagram illustrating the recording element substrate 100 as viewed from the second surface of the recording element substrate 100.

A discharge port forming member 105 can be formed of plastic. The discharge port forming member 105 is located on the first surface of the recording element substrate 100. The recording element substrate 100 is a device for discharging ink. Discharge ports 106 are disposed in array on the first surface of the discharge port forming member 105. In the present exemplary embodiment, the arrays of discharge ports 106 (discharge port arrays) are disposed along ink supply ports (liquid supply ports) 102 on both sides along a longitudinal direction of the ink supply ports 102. The ink supply ports 102 are provided on the recording element substrate 100.

On the second surface of the recording element substrate 100, a plurality of ink flow paths 109 (FIG. 4) formed as through-holes are open as the ink supply ports 102. The cross section of the ink flow paths 109 along the second surface of the recording element substrate 100 has the same shape as that of the ink supply ports 102. On the side of the second surface of the recording element substrate 100 along a longitudinal direction of the opening of the ink supply ports 102, heat transfer terminals 108 are provided. The heat transfer terminal 108 transfers heat generated by the recording element substrate 100 to the supporting member 200. The heat transfer terminal 108 is a metal element formed into an optional shape from a metal, such as gold (Au), copper (Cu), or solder. Also, similarly, on the second surface of the recording element substrate 100, an electric connection terminal 104 is provided on a location close to the end of a side of the recording element substrate 100 along a direction crossing the longitudinal direction of the ink supply ports 102. The electric connection terminal 104 is a metal terminal that is electrically connected to an electric wiring terminal portion 202 (FIG. 6) provided on the supporting member 200. This allows electric power and signals for use in discharging ink to be supplied from the supporting member 200 to the recording element substrate 100.

Figure 4:
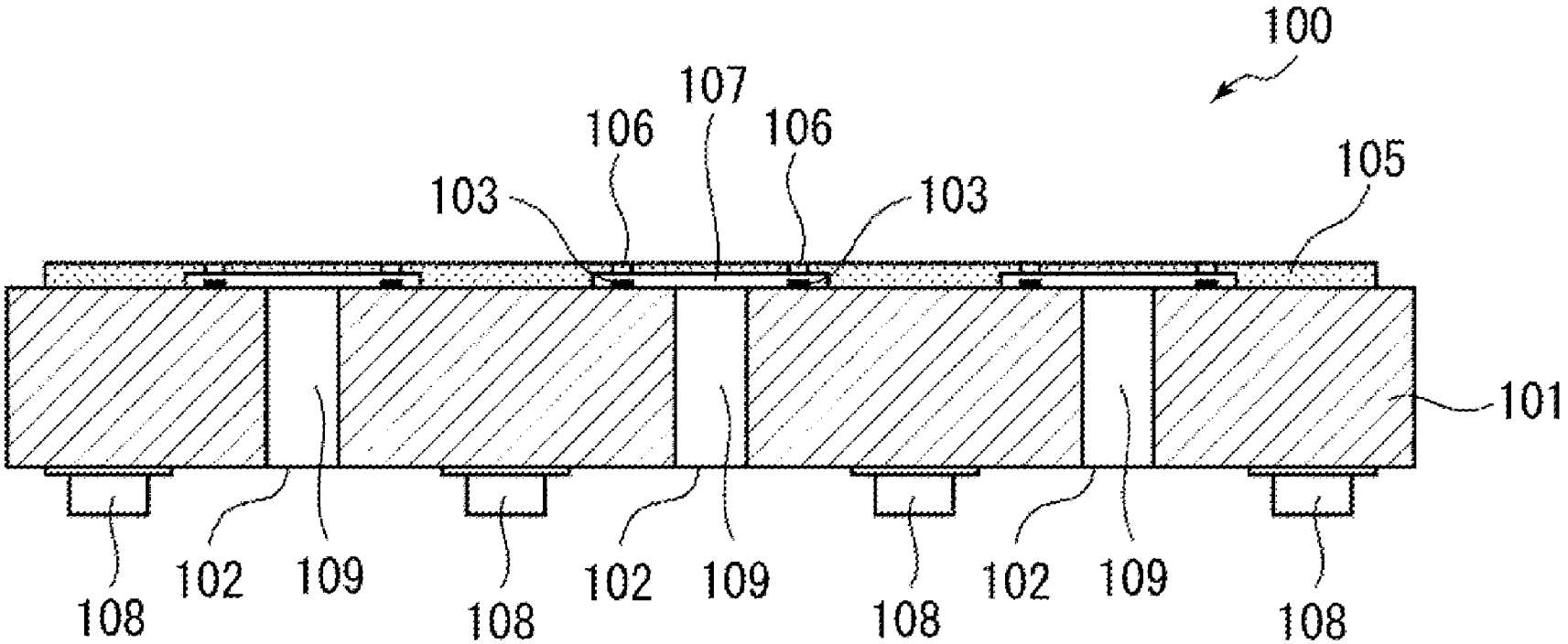
FIG. 4 is a cross sectional view illustrating a recording element substrate of an ink jet recording head taken along line 4-4 in FIG. 2 according to an exemplary embodiment of the present invention.

FIG. 4 is a schematic view illustrating the recording element substrate 100 of the ink jet recording head 90 and a cross sectional view taken along line 4-4 in FIG. 2.

In FIG. 4, a silicon (Si) substrate 101 serves as substrate of the recording element substrate 100. The ink flow paths 109 pass through the Si substrate 101. An ink chamber 107 is a space where ink receives thermal energy generated by a heating element 103. The ink is supplied from the side of the second surface of the recording element substrate 100 through the ink supply ports 102 and the ink flow paths 109. The ink chamber 107 communicates with the discharge port 106. The ink chamber 107 is provided with the heating elements 103 along both sides of the opening on the first surface of the ink flow paths 109. The ink chamber 107 is formed inside the discharge port forming member 105. The discharge port forming member 105 is provided on the first surface of the Si substrate 101. The discharge port forming member 105 is made of a plastic material.

Figure 5:
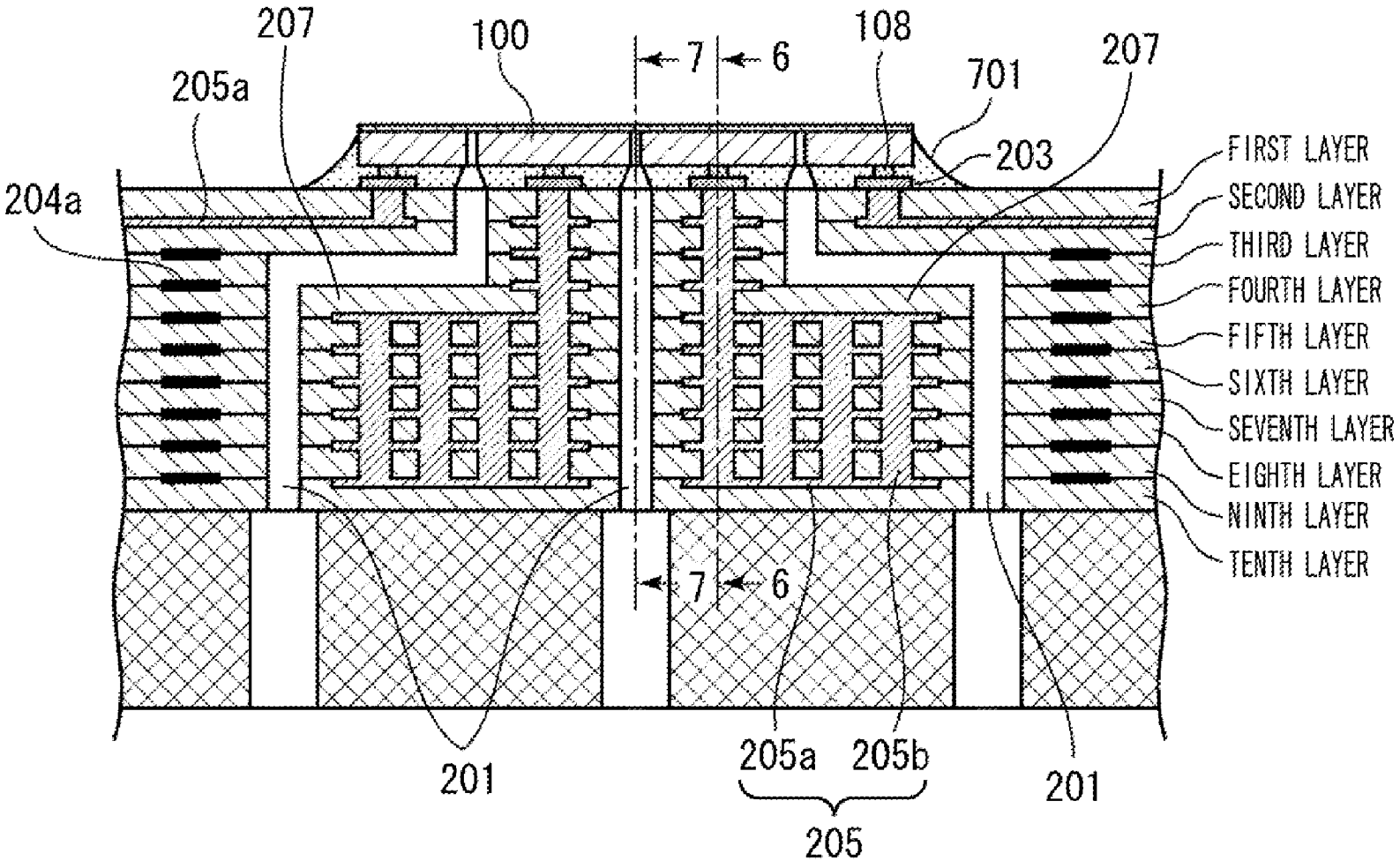
FIG. 5 is a cross sectional view illustrating an ink jet recording head taken along line 5-5 in FIG. 1 according to an exemplary embodiment of the present invention.
Figure 6:
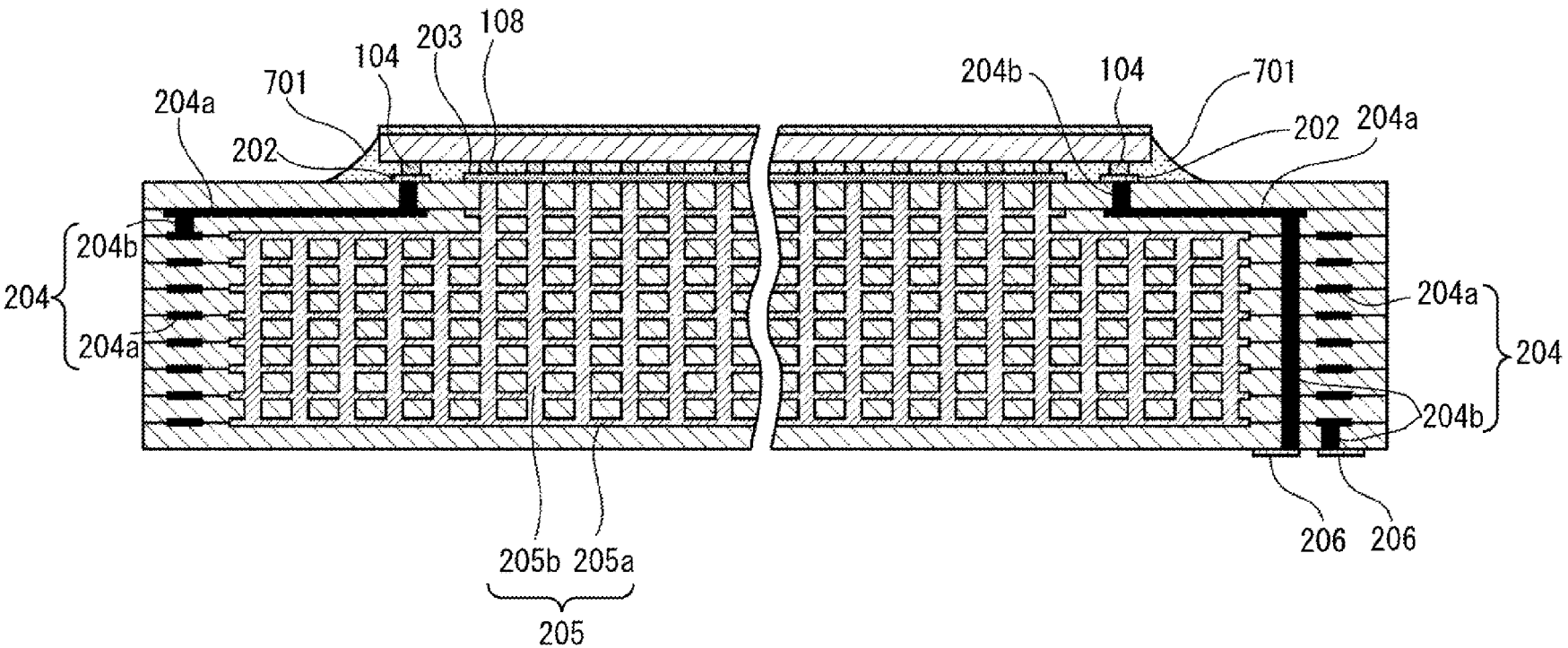
FIG. 6 is a cross sectional view illustrating an ink jet recording head taken along line 6-6 in FIG. 5 according to an exemplary embodiment of the present invention.
Figure 7:
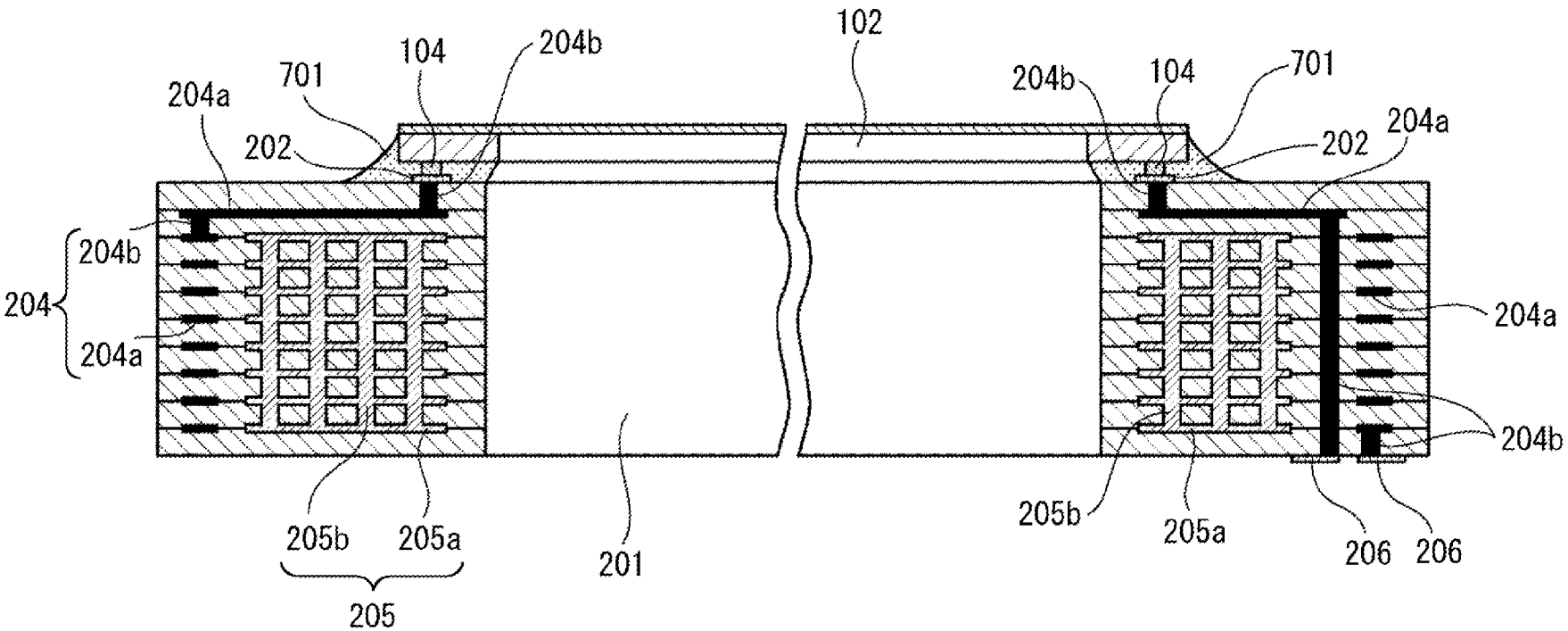
FIG. 7 is a cross sectional view illustrating an ink jet recording head taken along line 7-7 in FIG. 5 according to an exemplary embodiment of the present invention.

FIG. 5 is a cross sectional view illustrating the ink jet recording head 90 taken along line 5-5 in FIG. 1 according to an exemplary embodiment of the present invention. FIG. 6 is a cross sectional view illustrating the ink jet recording head 90 taken along line 6-6 in FIG. 5. FIG. 7 is a cross sectional view illustrating the ink jet recording head 90 taken along line 7-7 in FIG. 5.

The supporting member 200 is formed by lamination with a plurality of ceramic sheets having a thickness of about several tens of μm to 1 mm while retaining the accuracy of a mutual location and sintering and integrating those. As illustrated in FIG. 5, in an exemplary embodiment of the present invention, the supporting member 200 includes ten layers of ceramic sheets. Further, the supporting member 200 includes ink flow paths 201, which pass through the first surface and second surface of the supporting member 200 and communicate with the ink supply ports 102 of the recording element substrate 100.

A heat transfer terminal junction portion 203 is formed on a surface of the supporting member 200 which supports the recording element substrate 100 (the first surface of the supporting member 200). The heat transfer terminal junction portion 203 is connected to the corresponding heat transfer terminal 108 of the recording element substrate 100 to transfer heat. The heat transfer terminal junction portion 203 is connected to a heat transfer path 205 formed inside the supporting member 200. The heat transfer path 205 includes an interlayer heat transfer portion 205*a* and a via-hole heat transfer portion 205*b*. The via-hole heat transfer portion 205*b* includes an electrothermal conductive material inserted into a via hole to transfer heat. Further, the electric wiring terminal portion 202 is formed on a surface of the supporting member 200 which supports the recording element substrate 100 (the first surface of the supporting member 200). The electric wiring terminal portion 202 is connected to the corresponding electric connection terminal 104 of the recording element substrate 100 to attain electric conduction. Thus, the electric wiring terminal portion 202 is joined to the electric connection terminal 104 of the recording element substrate 100. The heat transfer terminal junction portion 203 is joined to the heat transfer terminal 108. The periphery of each junction portion is sealed by an adhesive or a sealing compound 701.

An external signal transmission and reception terminal portion 206 is formed on a surface different from the surface on which the electric wiring terminal portion 202 is provided, for example, an opposite surface (the second surface), or a side surface other than the first surface and the second surface of the supporting member 200. The external signal transmission and reception terminal portion 206 is provided to transmit and receive an electric signal from a recording apparatus main body. The external signal transmission and reception terminal portion 206 is electrically connected to the electric wiring terminal portion 202 via an internal electric wiring 204. The internal electric wiring 204 is formed inside the supporting member 200. The internal electric wiring 204 includes an interlayer electric wiring portion 204*a* and a via-hole wiring portion 204*b*. The via-hole wiring portion 204*b* includes an electrothermal conductive material inserted into a via hole to attain electric conduction.

Ceramic materials for forming the supporting member 200 include alumina, aluminum nitride, mullite, and low temperature calcined ceramics. These ceramic materials are chemically stable against ink. Further, conductive materials for forming the electric wiring terminal portion 202, the heat transfer terminal junction portion 203, the internal electric wiring 204, and the heat transfer path 205 include tungsten, molybdenum, platinum, gold, silver, copper, and platinum palladium. These conductive materials have high adhesion to the ceramic materials.

Figure 8:
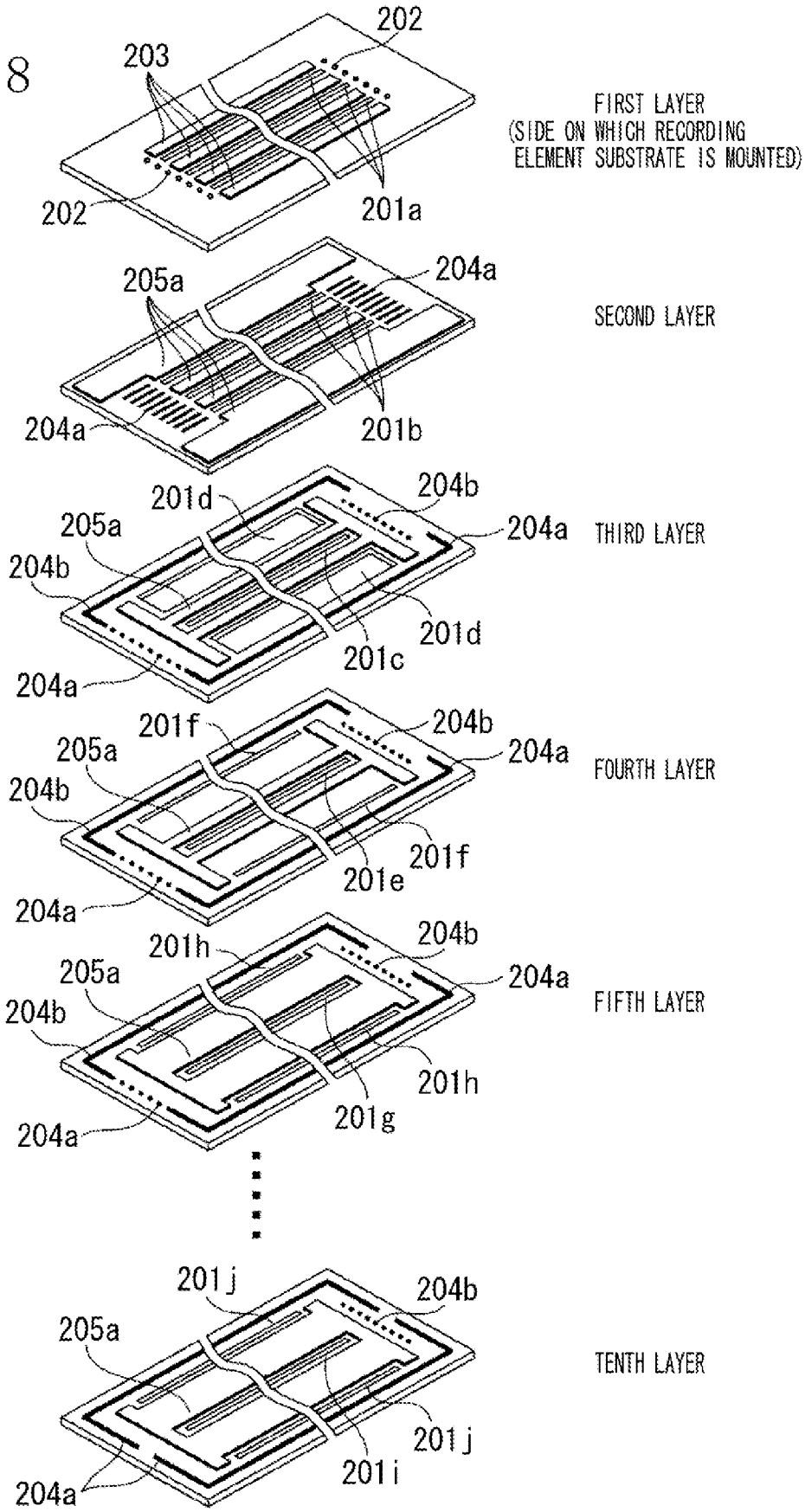
FIG. 8 is an exploded perspective view illustrating a supporting member of an ink jet recording head according to an exemplary embodiment of the present invention.

FIG. 8 is an exploded perspective view illustrating the supporting member 200 of the ink jet recording head 90 according to an exemplary embodiment of the present invention.

The supporting member 200 is a laminated structure formed by lamination with a plurality of sheets. The shape and location of an ink flow path and a heat transfer path are configured according to each sheet. The laminated structure will be described in detail below with reference to FIG. 8.

Layers are numbered in order from a layer close to the recording element substrate 100. On the sheet of the first layer, three ink flow paths 201*a* having a thin rectangular opening are formed in parallel in positions corresponding to the ink supply ports 102 of the recording element substrate 100. On both sides along a longitudinal direction of each of the ink flow paths 201*a*, the heat transfer terminal junction portion 203 is formed. Through-holes are formed inside the sheet of the first layer. The through-holes are connected to the heat transfer terminal junction portion 203 to enable heat transfer. The through-holes have a diameter of several tens of μm to several hundred μm. Inside the through-holes, a number of via-hole heat transfer portions 205*b* (FIGS. 5 and 6) are formed. The via-hole heat transfer portions 205*b* are filled with an electrothermal conductive material. Further, on both sides along a shorter side of the first layer, the electric wiring terminal portion 202 is formed. Furthermore, inside the sheet, the via-hole wiring portions 204*b* are formed. The via-hole wiring portions 204*b* are electrically connected to the electric wiring terminal portion 202.

On the sheet of the second layer, ink flow paths 201*b* having the same dimension and shape as the ink flow paths 201*a* provided on the sheet of the first layer are formed in a location corresponding to the sheet of the first layer to communicate with the ink flow paths 201*a*. Further, on both sides along a longitudinal direction of each of the ink flow paths 201*b*, the interlayer heat transfer portion 205*a* is formed. The interlayer heat transfer portion 205*a* is connected to the via-hole heat transfer portion 205*b* provided on the sheet of the first layer. The interlayer heat transfer portion 205*a* has a thickness of several μm to several tens of μm. A plurality of via-hole heat transfer portions 205*b* are formed inside the sheet of the second layer. The plurality of via-hole heat transfer portions 205*b* are connected to the interlayer heat transfer portions 205*a* to enable heat transfer. Further, on both sides along a shorter side of the second layer, the interlayer heat transfer portions 204*a* are formed on the first surface of the sheet of the second layer. The interlayer heat transfer portions 204*a* are connected to the via-hole heat transfer portions 204*b* provided on the sheet of the first layer. A number of via-hole heat transfer portions 204*b* are formed inside the sheet of the second layer. The via-hole heat transfer portions 204*b* are electrically connected to the interlayer heat transfer portions 204*a*.

On the sheet of the third layer, ink flow paths 201*c* and 201*d* are formed to communicate with the ink flow paths 201*b* provided on the sheet of the second layer. The ink flow path 201*c* located at the center part of the sheet of the third layer is formed in the same dimension and shape in a location corresponding to the ink flow path 201*b* provided on the sheet of the second layer. Further, in order to increase the opening interval of the ink flow paths 201 on the side of the lower layers of the laminated structure of the supporting member 200, the ink flow paths 201*d* located on both sides of the ink flow path 201*c* are formed into a shape widening an opening width outward along the shorter side direction of the third layer. Further, at an area located between the ink flow paths 201*c* and 201*d*, the interlayer heat transfer portions 205*a* are formed on the first surface of the sheet of the third layer. The interlayer heat transfer portions 205*a* are connected to the via-hole heat transfer portions 205*b* provided on the sheet of the second layer. The interlayer heat transfer portions 205*a* are connected to each other on both ends in a longitudinal direction of the third layer. A plurality of via-hole heat transfer portions 205*b* are formed inside the sheet of the third layer. The plurality of via-hole heat transfer portions 205*b* are connected to the interlayer heat transfer portions 205*a* to enable heat transfer. Also, on both sides along the shorter side direction of the third layer, the interlayer electric wiring portions 204*a* are formed on the first surface of the sheet of the third layer. The interlayer electric wiring portions 204*a* are electrically connected to the via-hole wiring portions 204*b* provided on the second layer. A number of via-hole wiring portions 204*b* are formed inside the sheet of the third layer. The via-hole wiring portions 204*b* are electrically connected to the interlayer electric wiring portions 204*a*.

On the sheet of the fourth layer, an ink flow path 201*e* is formed to communicate with the ink flow path 201*c* provided on the sheet of the third layer. Further, similarly, ink flow paths 201*f* are formed to communicate with the ink flow paths 201*d* provided on the sheets of the third layer. The ink flow path 201*e*, which is located at the center of the sheet of the fourth layer, is formed in the same dimension and shape as the ink flow paths 201*c* provided on the sheet of the third layer in a location corresponding to the ink flow paths 201*c*. The ink flow paths 201*f*, which are provided on both sides of the ink flow path 201*e*, have the same shaped and sized opening as that of the ink flow path 201*e*. At an area located between the ink flow paths 201*e* and 201*f*, the interlayer heat transfer portions 205*a* are formed on the first surface of the sheet of the fourth layer. The interlayer heat transfer portions 205*a* are connected to the via-hole heat transfer portions 205*b* provided on the sheet of the third layer to enable heat transfer. The interlayer heat transfer portions 205*a* are connected to each other at both ends in a longitudinal direction of the fourth layer. A number of via-hole heat transfer portions 205*b* are formed inside the sheet of the fourth layer. The via-hole heat transfer portions 205*b* are connected to the interlayer heat transfer portions 205*a* to enable heat transfer. Also, on both sides along a longitudinal direction of the fourth layer, the interlayer electric wiring portions 204*a* are formed on the first surface of the fourth layer. The interlayer electric wiring portions 204*a* are electrically connected to the via-hole wiring portions 204*b* provided on the sheet of the third layer. Via-hole wiring portions 204*b* connected to the interlayer electric wiring portions 204*a* are formed inside the sheet of the fourth layer.

On the sheet of the fifth layer, ink flow paths 201*g* and 201*h* are formed in the same dimension and shape in each corresponding location. The ink flow path 201*g* communicates with the ink flow path 201*e* provided on the sheet of the fourth layer. The ink flow paths 201*h* communicate with the ink flow paths 201*f* provided on the sheet of the fourth layer. At an area located between the ink flow paths 201*g* and 201*h*, the interlayer heat transfer portions 205*a* are formed in an area as large as possible on the first surface of the fifth layer. The interlayer heat transfer portions 205*a* are connected to the via-hole heat transfer portions 205*b* to enable heat transfer. The interlayer heat transfer portions 205*a* are connected to each other at both ends in a longitudinal direction of the fifth layer. A number of via-hole heat transfer portions 205*b* are formed in a size as large as possible inside the sheet of the fifth layer. The via-hole heat transfer portions 205*b* are connected to the interlayer heat transfer portions 205*a* to enable heat transfer. On both sides along a longitudinal direction of the fifth layer, the interlayer electric wiring portions 204*a* are formed on the first surface of the fifth layer. The interlayer electric wiring portions 204*a* are electrically connected to the via-hole wiring portions 204*b* provided on the sheet of the fourth layer. Via-hole wiring portions 204*b* connected to the interlayer electric wiring portions 204*a* are formed inside the sheet of the fifth layer.

The sheets of the sixth layer to the ninth layer have the same configuration as the sheet of the fifth layer.

On the sheet of the tenth layer, ink flow paths 201*i* and 201*j* are formed to communicate with the corresponding ink flow paths provided on the sheet of the ninth layer. Also, the interlayer heat transfer portions 205*a* are formed on the first surface of the sheet of the tenth layer. The interlayer heat transfer portions 205*a* are connected to the via-hole heat transfer portions 205*b* provided on the sheet of the ninth layer to enable heat transfer. The interlayer electric wiring portions 204*a* are formed on the first surface of the sheet of the tenth layer. The interlayer electric wiring portions 204*a* are electrically connected to the via-hole wiring portions 204*b* provided on the sheet of the ninth layer. Then, as illustrated in FIG. 6, via-hole wiring portions 204*b* are formed inside the sheet of the tenth layer. The via-hole wiring portions 204*b* connect the interlayer electric wiring portions 204*a* provided on the sheet of the tenth layer to the external signal transmission and reception terminal portion 206.

The above-described configuration widens the interval between three ink flow paths 201 in the sheets of the fifth layer to the tenth layer, thus allowing an increase in volume of a partition wall portion 207 that separates the ink flow paths 201 from each other. Thus, a heat capacity is increased by increasing the volume of the partition wall portion 207 between the ink flow paths 201, thus enhancing heat transferability from the heat transfer terminal 108 of the recording element substrate 100 to the supporting member 200. Also, using a high-thermal conductivity material in the heat transfer path 205 inside the supporting member 200 further enables an increase in heat transferability.

Further, a large number of heat transfer paths 205 can be disposed within the limits of a possible disposition inside the partition wall portion 207. In order to increase heat transferability, as illustrated in FIGS. 5 and 6, at least the via-hole heat transfer portions 205*b* on the first layer of the supporting member 200 connected to the heat transfer terminal junction portion 203 can be located directly under the heat transfer terminal 108 of the recording element substrate 100. In each exemplary embodiment of the present invention which will be described below, the via-hole heat transfer portions 205*b* are disposed such that the number of via-hole heat transfer portions 205*b* per sheet is larger in the sheet of a layer close to the second surface of the supporting member 200 than in the sheet of a layer close to the first surface of the supporting member 200. As described above, the interval between the ink flow paths 201, serving as through-holes, is widened to increase the volume of the heat transfer path 205 disposed inside the partition wall portion 207. Accordingly, the heat transferability of the partition wall portion 207, in which the heat transfer path 205 is disposed, can be enhanced according to an increase in interval between the ink flow paths 201. Thus, the heat transferability from the heat transfer terminal 108 of the recording element substrate 100 to the supporting member 200 and the heat radiation characteristic of the supporting member 200 can be improved.

Figure 9:
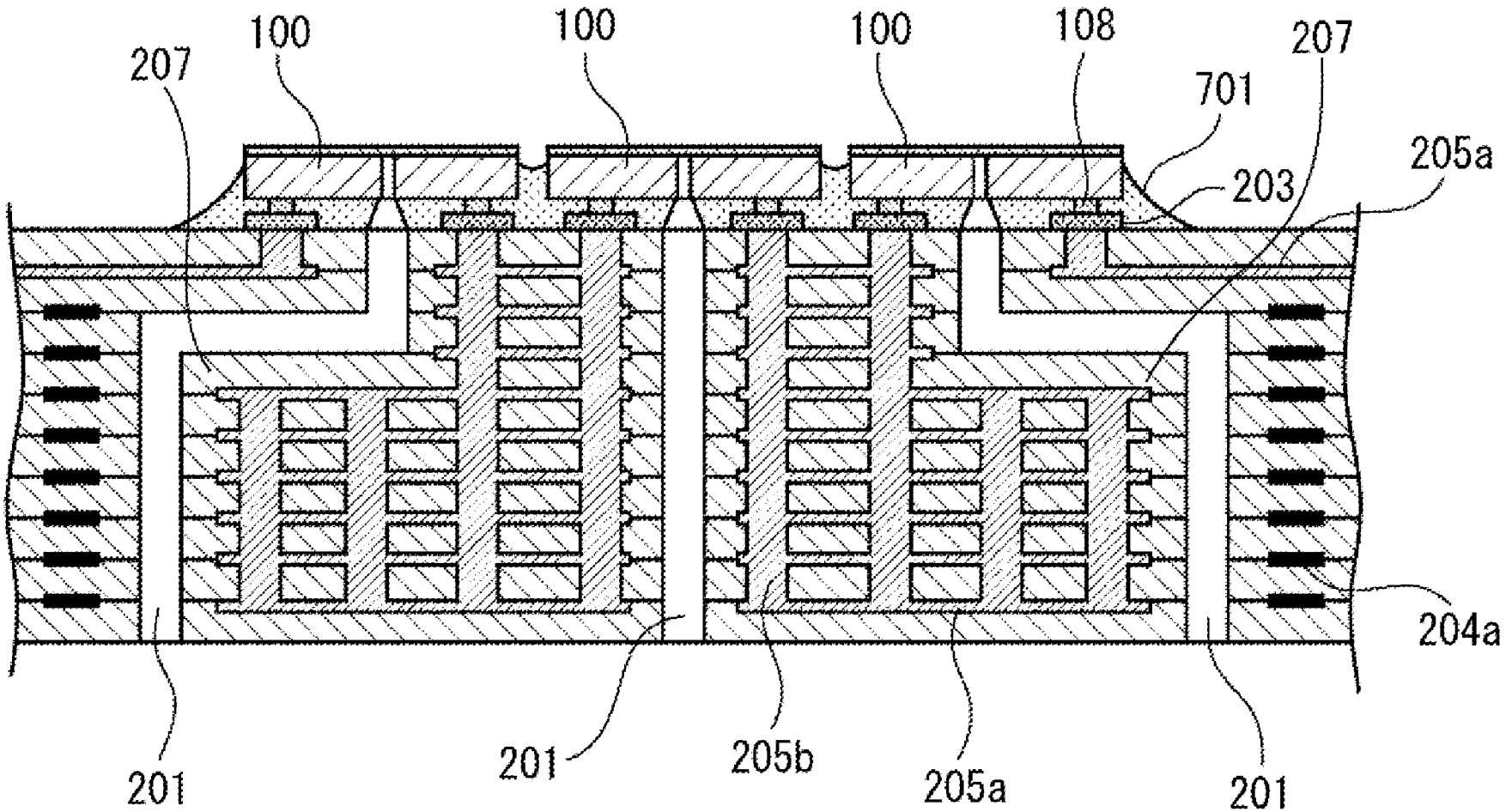
FIG. 9 is a cross sectional view illustrating a configuration of an ink jet recording head according to an exemplary embodiment of the present invention.
Figure 10:
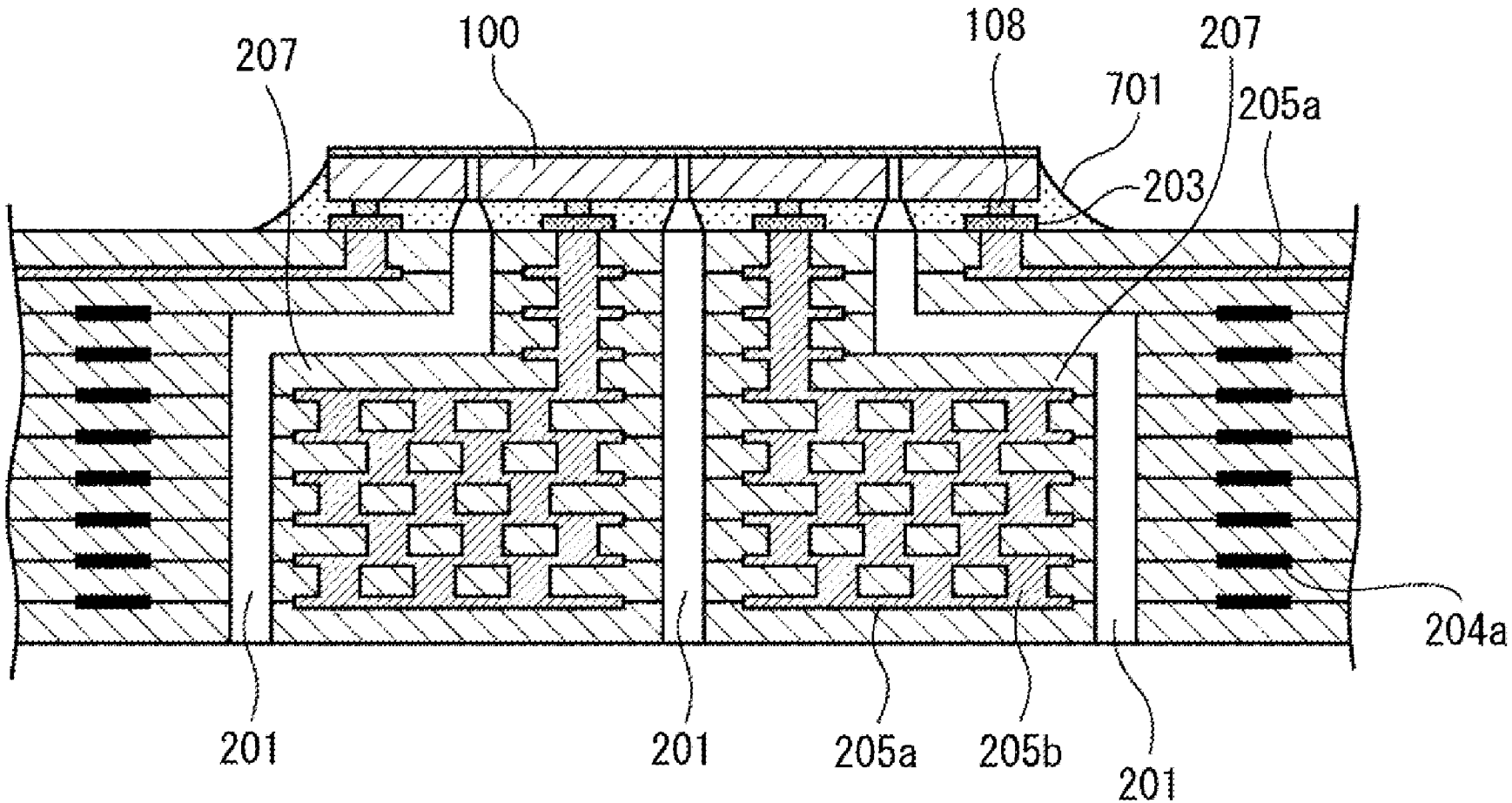
FIG. 10 is a cross sectional view illustrating a configuration of an ink jet recording head according to an exemplary embodiment of the present invention.
Figure 11:
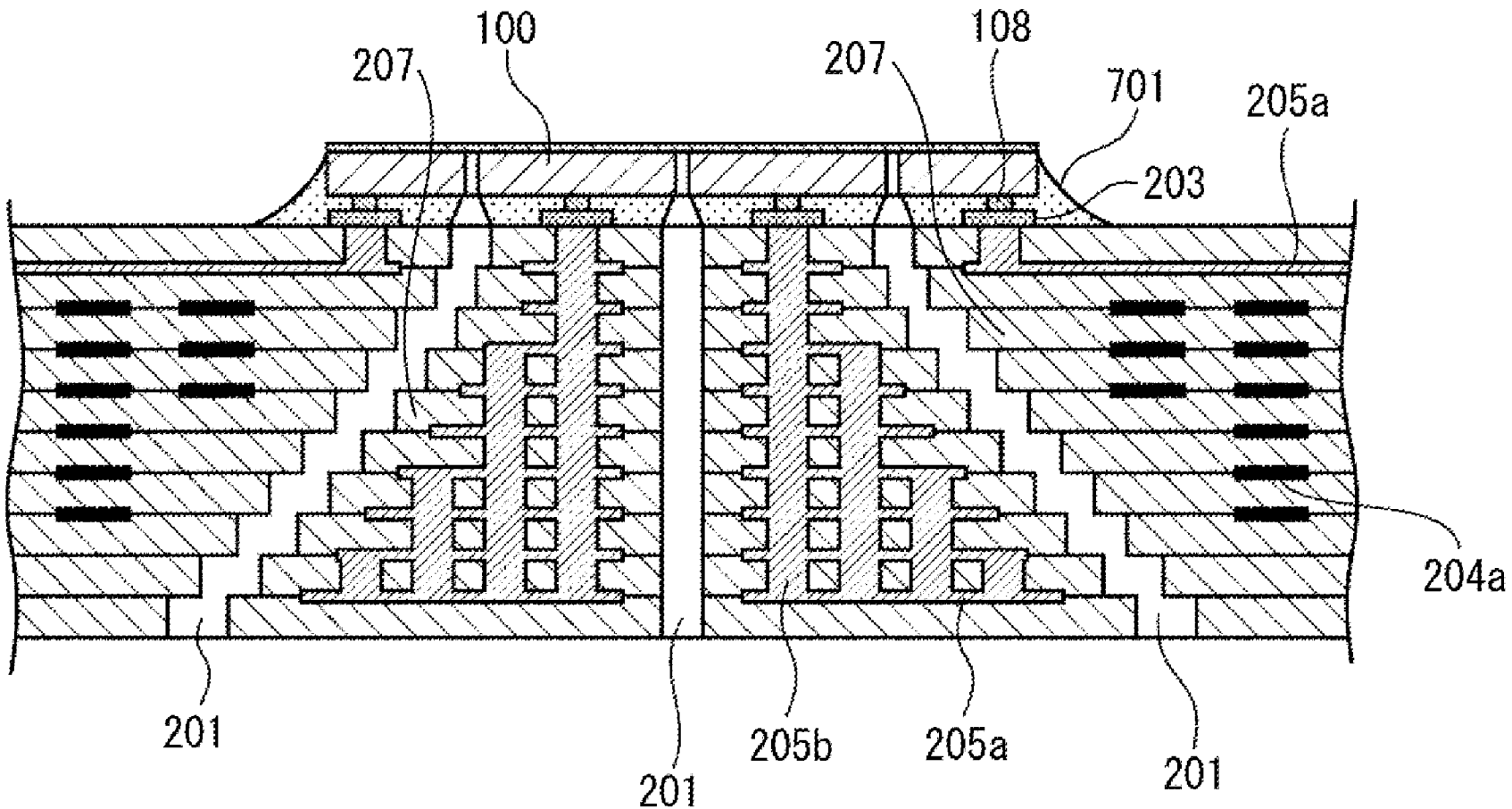
FIG. 11 is a cross sectional view illustrating a configuration of an ink jet recording head according to an exemplary embodiment of the present invention.
Figure 12:
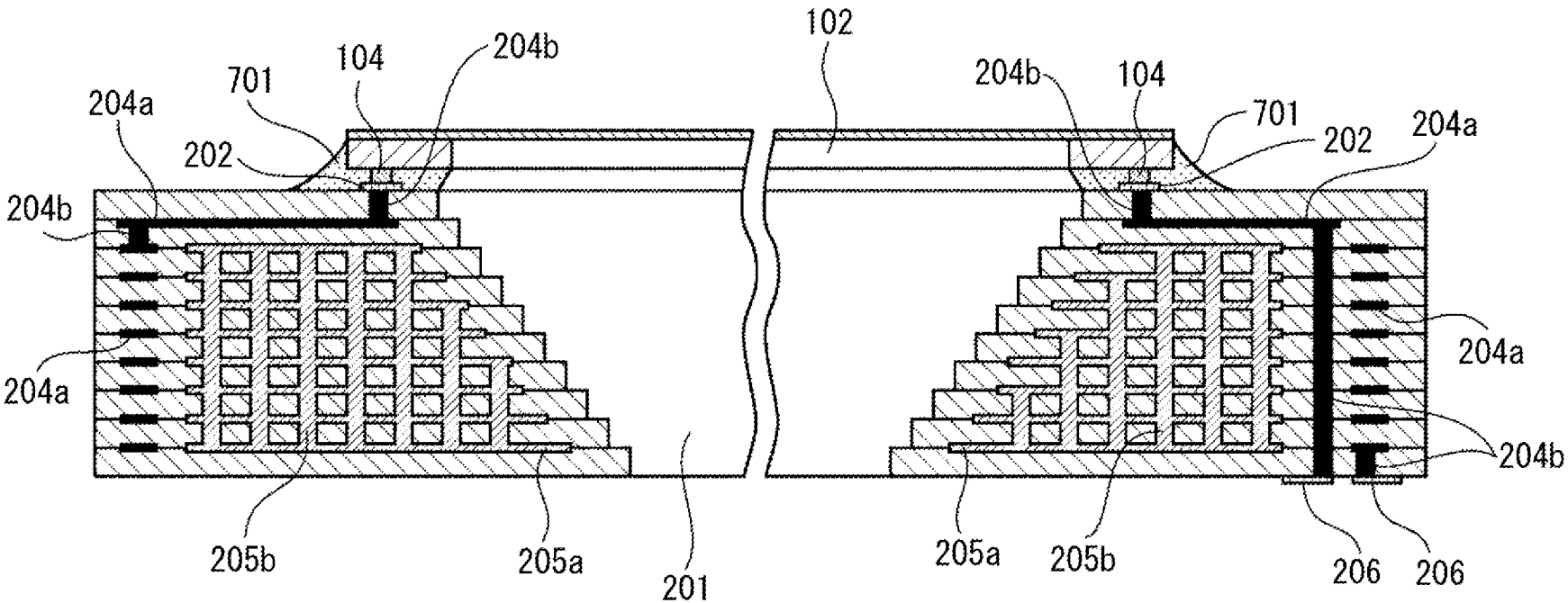
FIG. 12 is a cross sectional view illustrating a configuration of an ink jet recording head according to an exemplary embodiment of the present invention.

Furthermore, as illustrated in FIG. 9, even in a recording head including a plurality of recording element substrates 100 each having one ink supply port 102 and disposed in parallel, the interval between the ink flow paths 201 is widened to increase the volume of the heat transfer path 205 disposed inside the partition wall portion 207. Accordingly, the heat transferability of the partition wall portion 207, in which the heat transfer path 205 is disposed, can be enhanced according to an increase in interval between the ink flow paths 201. Thus, the heat transferability from the heat transfer terminal 108 of the recording element substrate 100 to the supporting member 200 and the heat radiation characteristic of the supporting member 200 can be improved. FIG. 9 illustrates the recording head while omitting the ink supply member 500. Further, the shape of the ink flow paths 201 and the disposition pattern and the dimension of the heat transfer path 205 are not limited to those illustrated in the drawings, but may be formed in any shape, disposition pattern, and dimension. Exemplary embodiments of the present invention will be described below in FIGS. 10 to 12. FIGS. 10 to 12 illustrates recording heads while omitting the ink supply member 500.

In FIG. 10, the via-hole heat transfer portions 205*b* formed on the ceramic sheet of each layer are disposed to shift in location so as not to align in a direction away from the recording element substrate 100 inside the supporting member 200 corresponding to the second surface of the recording element substrate 100. Thus, the interval between the ink flow paths 201 is widened to increase the volume of the heat transfer path 205 disposed inside the partition wall portion 207. Even with this configuration, the heat transferability of the partition wall portion 207, in which the heat transfer path 205 is disposed, can be enhanced according to an increase in interval between the ink flow paths 201. Thus, the heat transferability from the heat transfer terminal 108 of the recording element substrate 100 to the supporting member 200 and the heat radiation characteristic of the supporting member 200 can be improved. Also, this configuration can dispose alumina and a conductive material, having different hardness, in a dispersed manner in a pressure process (process for integrating a plurality of ceramic sheets) when the supporting member 200 is manufactured. Thus, the flatness in the first surface and the second surface of the supporting member 200 can be enhanced.

In FIG. 11, the ink flow paths 201 are configured such that the interval between the ink flow paths 201 gradually increases as extending away from the surface that supports the recording element substrate 100. Thus, the interval between the ink flow paths 201 is widened to increase the volume of the heat transfer path 205 disposed inside the partition wall portion 207. Even with this configuration, the heat transferability of the partition wall portion 207, in which the heat transfer path 205 is disposed, can be enhanced according to an increase in interval between the ink flow paths 201. Thus, the heat transferability from the heat transfer terminal 108 of the recording element substrate 100 to the supporting member 200 and the heat radiation characteristic of the supporting member 200 can be improved. This configuration can increase the interval between the ink flow paths 201 without forming a larger opening on one layer than that on other layers. In a pressure process when the supporting member 200 is manufactured, the supporting member 200 does not receive a load partially and excessively in a direction of lamination of ceramic sheets. Accordingly, a defective shape of the ink flow paths 201 of the supporting member 200 can be prevented. Thus, the flatness of the first surface and the second surface of the supporting member 200 can be enhanced. Further, this configuration also provides excellent ink flow properties.

FIG. 12 is a cross sectional view taken along line 7-7 in FIG. 5 similar to FIG. 7. In FIG. 12, the cross sectional view along a longitudinal direction of the ink flow path 201 of the supporting member 200 is made into a taper shape in which the opening on the side of the surface that supports the recording element substrate 100 is larger than that on the side of the opposite surface. Further, in a region of the ceramic laminated body which forms a taper portion, an additional heat transfer path 205 is formed. The additional heat transfer path 205 is connected to the heat transfer path 205 formed in the partition wall portion 207 to enable heat transfer. This configuration reduces areas that block heat transfer with the ink flow path 201. This configuration provides a greater number of heat transfer paths 205 and allows an increase in heat transferability. Thus, an inkjet recording head excellent in heat transfer character of the recording element substrate 100 can be provided. Furthermore, this configuration can improve the flow of ink.

Figure 13:
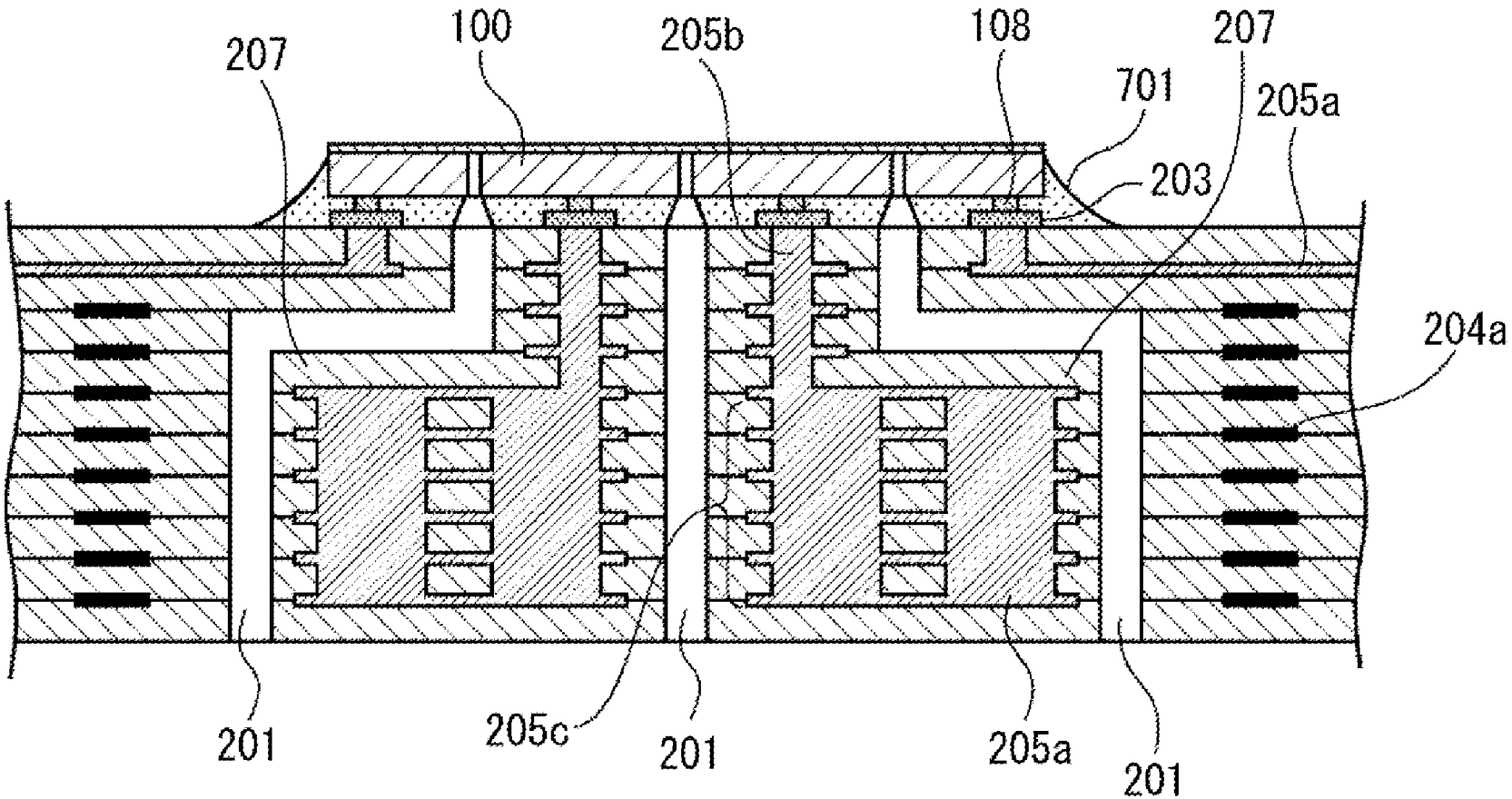
FIG. 13 is a cross sectional view illustrating a configuration of an ink jet recording head according to an exemplary embodiment of the present invention.

FIG. 13 illustrates a structure in which a via-hole heat transfer portion having a cross sectional area larger than that of the via-hole heat transfer portions 205*b* on the layer that forms a surface of the supporting member 200 supporting the recording element substrate 100 is formed in a region of the ceramic laminated body in which the interval between the ink flow paths 201 is increased. The cross sectional area has a size of the cross section in a direction along the surface of the sheet in which the via-hole heat transfer portion 205*b* is formed. Thus, the interval between the ink flow paths 201 is widened to increase the volume of the heat transfer path 205 disposed inside the partition wall portion 207. Even with this configuration, the heat transferability of the partition wall portion 207, in which the heat transfer path 205 is disposed, can be enhanced according to an increase in interval between the ink flow paths 201. Thus, the heat transferability from the heat transfer terminal 108 of the recording element substrate 100 to the supporting member 200 and the heat radiation characteristic of the supporting member 200 can be improved. The recording head illustrated in FIG. 13 includes ink flow paths 201 having the shape similar to that illustrated in FIG. 5. Inside the sheet of the fifth layer, via-hole heat transfer portions 205*c* are formed. The via-hole heat transfer portions 205*c* have a cross sectional area larger than that of the via-hole heat transfer portions 205*b* formed on the first layer to the fourth layer.

Figure 14:
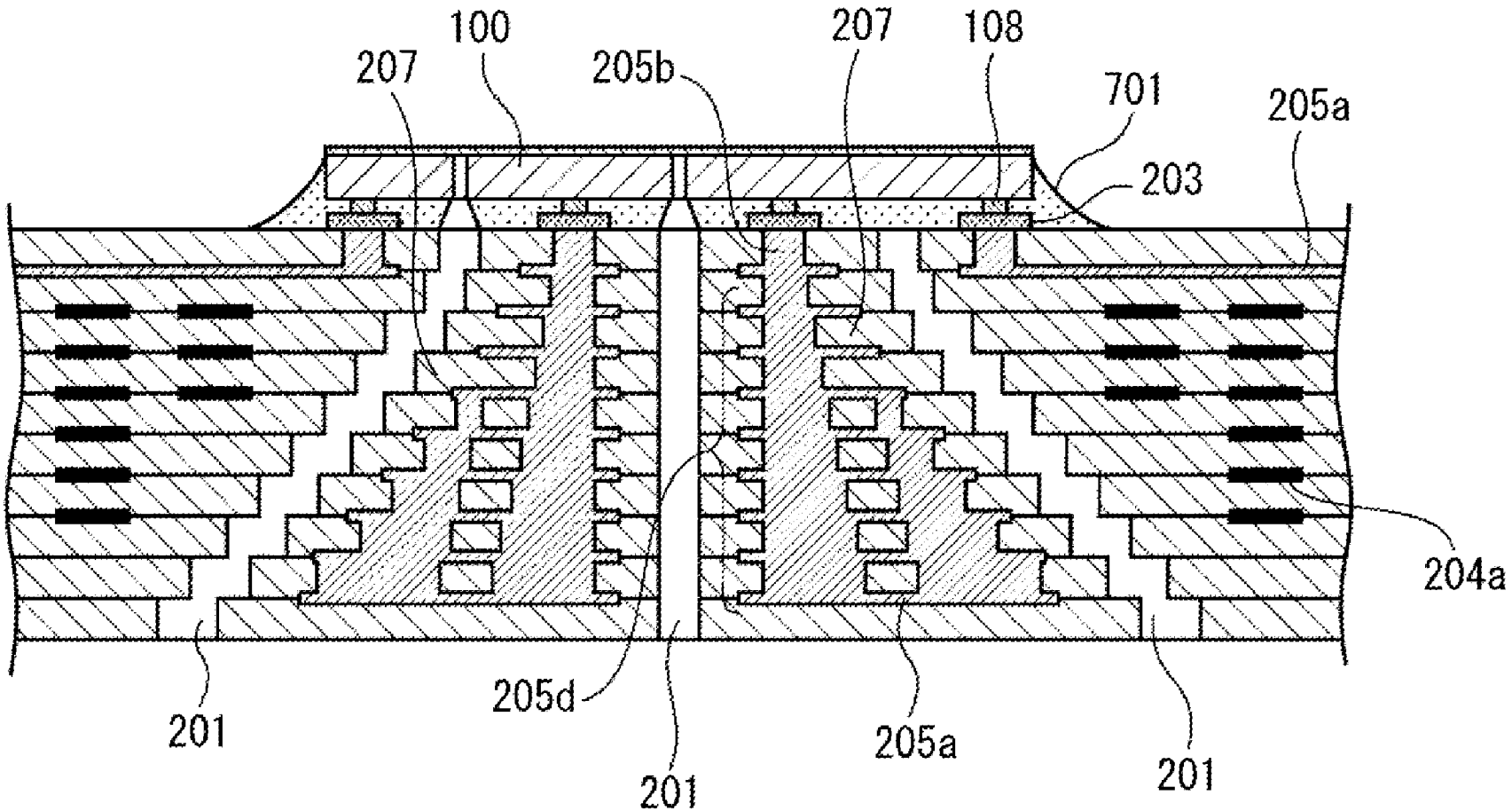
FIG. 14 is a cross sectional view illustrating a configuration of an ink jet recording head according to an exemplary embodiment of the present invention.
Figure 15:
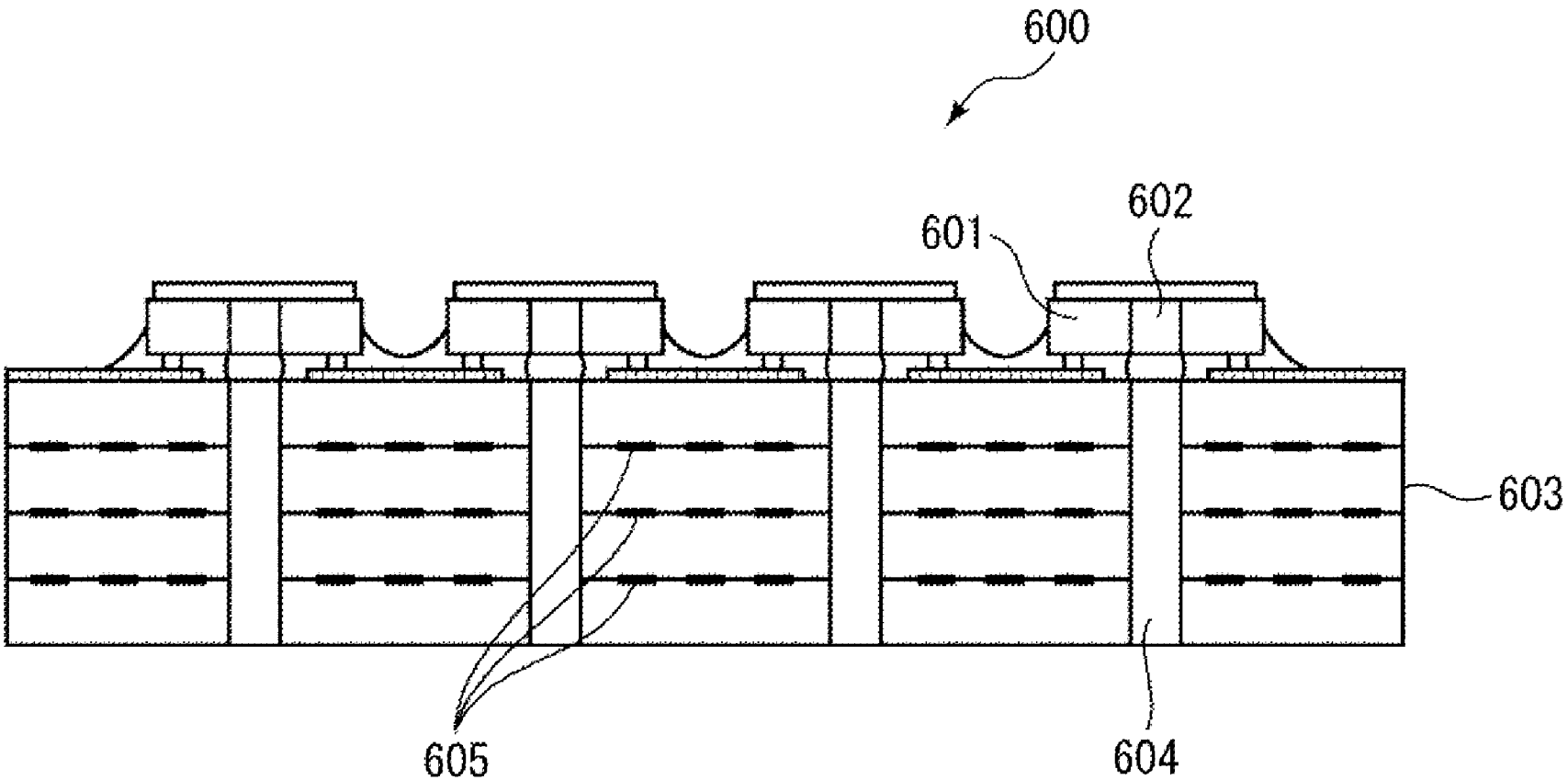
FIG. 15 PRIOR ART
FIG. 15 is a cross sectional view illustrating a conventional ink jet recording head.

FIG. 14 illustrates a recording head having the shape of a flow path similar to FIG. 11. In FIG. 14, via-hole heat transfer portions 205*d* are formed such that the cross sectional area gradually increases from the second layer toward the ninth layer with respect to the cross sectional area of the via-hole heat transfer portion 205*b* formed on the first layer. Thus, the interval between the ink flow paths 201 is widened to increase the volume of the heat transfer path 205 disposed inside the partition wall portion 207. Even with this configuration, the heat transferability of the partition wall portion 207, in which the heat transfer path 205 is disposed, can be enhanced according to an increase in interval between the ink flow paths 201. Thus, the heat transferability from the heat transfer terminal 108 of the recording element substrate 100 to the supporting member 200 and the heat radiation characteristic of the supporting member 200 can be improved. This configuration can increase the area for mutually connecting the via-hole heat transfer portions 205*d* in the supporting member 200 which adopts a taper-like flow path structure. Accordingly, this configuration can improve the efficiency of heat transfer. Thus, an ink jet recording head excellent in heat radiation characteristic can be provided.

In an exemplary embodiment of the present invention, a wiring that is electrically connected to the recording element substrate 100 is formed inside the supporting member 200. However, the wiring can be electrically connected to recording element substrate 100 in a configuration in which the wiring does not pass through the inside of the supporting member 200.

Further, in an exemplary embodiment of the present invention, the heat transfer path 205 is provided as a wiring that is unrelated to electric connection and only directed to heat transfer. However, the heat transfer path 205 can serve as not only a heat transfer path but also an electric wiring.

Furthermore, in an exemplary embodiment of the present invention, only the heat transfer path 205 is disposed in the partition wall portion 207. However, a part of the internal electric wiring 204 of the supporting member 200 can be formed inside the partition wall portion 207 for the purpose of reducing the dimension of the supporting member 200 itself. In this case, the formation of the internal electric wiring 204 in a location away from the location that supports the recording element substrate 100 can sufficiently secure an area for disposing the heat transfer path 205 and does not cause the loss of a heat radiation characteristic.

As described above, according to an exemplary embodiment of the present invention, an increase of the interval between liquid flow paths inside a supporting member increases the volume of a partition wall portion located between the liquid flow paths to increase a heat capacity and improves the heat transferability from a heat transfer terminal of a discharge element substrate to the supporting member and the heat radiation characteristic of the supporting member. Also, the interval between the liquid flow paths, serving as through-holes, is widened to increase the volume of a heat transfer path disposed inside the partition wall portion. Accordingly, the heat transferability of the partition wall portion, in which the heat transfer path is disposed, can be enhanced according to an increase in interval between the liquid flow paths. Thus, the heat transferability from the heat transfer terminal of the discharge element substrate to the supporting member and the heat radiation characteristic of the supporting member can be improved.

Also, the use of a high-thermal conductivity material at the heat transfer path inside the supporting member further increases heat transferability.

Accordingly, even in a case where a plurality of liquid flow paths are formed in the supporting member at a narrower interval in parallel to miniaturize the liquid discharge head, a rise in temperature of the discharge element substrate can be reduced.

Furthermore, even in a discharge element substrate having a large number of heating elements in a high density and having a relatively large dimension in a longitudinal direction, a rise in temperature at the center part in the longitudinal direction of the discharge element substrate can effectively be reduced.

Furthermore, in a junction portion between a supporting member and a liquid supply member, since the disposition interval between liquid flow paths can be increased, the junction of the supporting member and the liquid supply member can be facilitated.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2006-344268 filed Dec. 21, 2006, which is hereby incorporated by reference herein in its entirety.

What is claimed is:

1. A liquid discharge head comprising:

a discharge element including, on a front surface thereof, a discharge port adapted to discharge a liquid and, on a second surface thereof, a liquid supply port communicating with the discharge port, an electric connection terminal, and a heat transfer terminal; and a supporting member including a first surface, a second surface, an electric connection terminal portion formed on the first surface of the supporting member and electrically connected to the electric connection terminal, a heat transfer terminal junction portion formed on the first surface of the supporting member and connected to the heat transfer terminal to transfer heat, a plurality of through-holes extending between the first surface and the second surface of the supporting member, a partition wall portion separating the through-holes from each other, and a heat transfer path connected to the heat transfer terminal junction portion, the supporting member supporting the discharge element on the first surface of the supporting member, wherein the through-holes communicate with the liquid supply port and are formed such that an interval between the through-holes increases according to a direction from the first surface to the second surface of the supporting member, and wherein a volume of the heat transfer path increases according to the increase of the interval.

2. The liquid discharge head according to claim 1, wherein the supporting member includes a plurality of sheets as a laminated structure, and wherein the heat transfer path includes an interlayer heat transfer portion formed on a surface of each sheet and a via-hole heat transfer portion formed inside each sheet, the via-hole heat transfer portion including an electrothermal conductive material inserted into a via hole.

3. The liquid discharge head according to claim 2, wherein the supporting member further includes an internal electric wiring, the internal electric wiring including an interlayer electric wiring portion formed on a surface of each sheet and a via-hole wiring portion formed inside each sheet, the via-hole wiring portion including an electrothermal conductive material inserted into a via hole, the internal electric wiring being electrically connected to the electric connection terminal portion.

4. The liquid discharge head according to claim 2, wherein a cross section of the via-hole heat transfer portion formed inside a sheet located close to the second surface of the supporting member along a surface of the sheet is larger than that of the via-hole heat transfer portion formed inside a sheet located close to the first surface of the supporting member along a surface of the sheet.

5. The liquid discharge head according to claim 2, wherein a number of the via-hole heat transfer portions formed inside a sheet located close to the second surface of the supporting member is greater than that of the via-hole heat transfer portions formed inside a sheet located close to the first surface of the supporting member.

* * * * *